US005489360A

United States Patent [19]

Shimizu et al.

[11] Patent Number: 5,489,360

[45] Date of Patent: Feb. 6, 1996

[54] LABEL STICKING APPARATUS AND LABEL TAPE

[75] Inventors: Yukiya Shimizu; Masayuki Kubota, both of Kanagawa, Japan

[73] Assignee: Fuji Photo Film Co., Ltd., Kanagawa, Japan

[21] Appl. No.: 317,469

[22] Filed: Oct. 4, 1994

[30] Foreign Application Priority Data

Oct. 4, 1993 [JP] Japan ..... 5-248023

[51] Int. Cl.[6] ..... B65C 9/18

[52] U.S. Cl. ..... 156/542; 156/567; 156/568; 271/120; 271/232; 271/234; 271/276

[58] Field of Search ..... 271/234, 232, 271/226, 276, 120; 156/542, 540, 568, 566, 567

[56] References Cited

U.S. PATENT DOCUMENTS

| | | | |
|---|---|---|---|
| 250,304 | 11/1881 | Viellemard | 271/232 |
| 625,095 | 5/1899 | Dexter | 271/232 |
| 863,321 | 8/1907 | Scott | 271/234 |
| 2,157,556 | 5/1939 | Menschner | 216/25 |
| 2,922,192 | 1/1960 | Morin . | |
| 4,302,277 | 11/1981 | Ilsemann | 156/567 |
| 4,602,977 | 7/1986 | Voltmer et al. | 271/276 X |
| 4,735,664 | 4/1988 | Asghar et al. | 156/542 X |
| 4,735,668 | 4/1988 | Hoffmann et al. | 156/568 X |
| 4,747,905 | 5/1988 | Ilsemann | 156/542 |
| 4,842,660 | 6/1989 | Voltmer et al. | 156/542 X |
| 5,049,912 | 9/1991 | Pagano et al. | 354/275 |
| 5,061,334 | 10/1991 | Paules | 156/542 X |

FOREIGN PATENT DOCUMENTS

| | | | |
|---|---|---|---|
| 0006505 | 1/1980 | European Pat. Off. | B65C 1/04 |
| 131852 | 1/1985 | European Pat. Off. | 156/542 |
| 0218925 | 4/1987 | European Pat. Off. | B65C 1/04 |
| 63-62422 | 12/1988 | Japan | B65C 9/42 |
| 5032358 | 2/1993 | Japan | 271/226 |
| 670976 | 6/1979 | U.S.S.R. | 271/120 |
| 1437463 | 5/1976 | United Kingdom | 156/541 |
| 2079242 | 1/1982 | United Kingdom | 156/568 |

*Primary Examiner*—David A. Simmons
*Assistant Examiner*—Steven J. Helmer
*Attorney, Agent, or Firm*—Sughrue, Mion, Zinn, Macpeak & Seas

[57] ABSTRACT

A label sticking apparatus has a suction drum with at least three holding-sticking units mounted at constant intervals on the periphery thereof so as to be movable in radial directions of the suction drum. The suction drum is rotated intermittently by a constant amount so as to feed and stop the holding-sticking units at a label feeding station, a positioning station and a sticking station which are disposed around the suction drum in this sequence. Labels are seriatim peeled from a label tape and held on a distal end of the holding-sticking unit at the label feeding station. At the positioning station, positioning of each label is performed by a positioning head having a centering pin and a pair of angular position correction pins. At the sticking station, the holding-sticking unit is pushed through an eccentric cam radially outward from the suction drum toward a work-piece, to press and stick the label held on the holding-sticking unit onto the work-piece.

15 Claims, 8 Drawing Sheets

LABEL STICKING APPARATUS AND LABEL TAPE

BACKGROUND OF THE INVENTION

1. Field of the Invention

The present invention relates to a label sticking apparatus which can stick labels on mass-produced work-pieces at a high speed, and a label tape suitable for that label sticking apparatus. The present invention relates more particularly to a label sticking apparatus suitable for sticking circular bar code labels on flanges of spools of photographic film cassettes, and a label tape for use in the label sticking apparatus.

2. Related Art

In order to stick labels on work-pieces including articles and parts, various kinds of label sticking apparatus have been known wherein labels are automatically peeled from a label tape by means of a peeling edge, held by pads or drum through vacuum adsorption, and stuck on the work-pieces by means of the pads or the drum.

For example, JPB 63-62422 and U.S. patent application Ser. No. 225,669 (filed on 27 July 1988), now U.S. Pat. No. 4,842,660, disclose a label sticking apparatus which peels labels from a label tape by means of a peeling edge, and adsorptively holds labels on the periphery of a rotary suction drum, and wherein a feed line for feeding work-pieces to be labeled is disposed near the suction drum and driven in synchronism with the rotation of the suction drum so that the labels are successively stuck on the work-pieces which are passed near by the suction drum.

There are also such label sticking apparatus that have a label position adjusting or correcting device. In a known label sticking apparatus as shown in FIG. 11, a label 2*a* is peeled from a label tape 2 at a peeling edge 3, and attached to a holding-sticking unit 4 by vacuum suction. Thereafter, the orientation or position of the label 2*a* is corrected by pushing the label 2*a* with pushing members 5*a* and 5*b* in X- and Y-directions individually by an appropriate amount, as is shown in FIG. 12. Then, the holding-sticking unit 4 is moved downward by an up-down cylinder 6, to put the label 2*a* on a work-piece to be labeled.

In another known label sticking apparatus having a label position correcting device, as shown in FIG. 13, a suction drum 7 is rotated about a vertical axis, and has label holding hooks 7*a* and bottom supporting bars 7*b* provided on the periphery thereof. In this apparatus, vacuum adsorbability of a label 2*b* is lowered before sticking the label 2*b*, so that the label 2*b* slips down to the bottom supporting bar 7*b* due to its weight. As a result, the label 2*b* is positioned in the vertical direction with its bottom line horizontal. Since the suction drum 7 continues to rotate while the vacuum adsorption is terminated, the label 2*b* is shifted relative to the suction drum 7 toward the holding hooks 7*a*. Thus, the label 2*b* is positioned in the horizontal direction. The label 2*b* thus correctly positioned is stuck on a work-piece 9 conveyed on a conveyer belt 8.

By the way, it is known in the art to provide DX codes on photographic film or photographic film cassettes so as to facilitate knowing the kind and speed of the photographic film, the number of available frames, the valid period, the production lot number, the manufacturer, and other information by which the photographic film is identified in the factory. The DX codes are, for example, recorded on a magnetic recording layer provided on the photographic film, so as to be read by a magnetic head. Or the DX codes are recorded as bar codes on the outer surface of a cassette shell, to be read by a bar code sensor. Recently, a photographic film cassette having a bar code disc incorporated therein so as to be rotatable along with a spool of the cassette, and a camera having a bar code sensor for reading bar codes on the bar code disc have been disclosed, for example, in U.S. Pat. No. 5,049,912.

Because the bar code disc is made of plastic, it is difficult to print bar codes directly on the bar code disc. For this reason, a label having bar codes printed thereon is stuck on the disc. It is desirable, for sticking the bar code labels on the discs, to use an automatic label sticking apparatus. However, since the bar code disc is circular, the bar code label may also be circular or sectorial, and should be disposed coaxially with the disc. If the rotational axis of the bar code label deviate from that of the disc, the accuracy of decoding of the bar codes is diminished.

The above-described known position correcting devices might be applicable to correct the position of the bar code label. However, the device as shown in FIG. 11 and 12 needs two pushing members for pushing a label in X- and Y-directions, i.e. two-dimensionally, and at least two steps of position correcting operations. Moreover, since the positioning and the sticking are carried out in the same operation cycle using a single holding-sticking unit, it is impossible to achieve a high speed or high efficiency label sticking operation. Not only the device as shown in FIGS. 11 and 12 but also the device as shown in FIG. 13 cannot precisely position circular labels such as the bar code labels, because there is no guide member for determining the center of the circular label. Especially when the angular position as well as the center of the labels are to be exactly determined relative to the work-piece to be labeled, the known sticking devices cannot sufficiently operate.

OBJECT OF THE INVENTION

In view of the foregoing, a primary object of the present invention is to provide a label sticking apparatus which can operate at a high speed while precisely correcting the position or orientation of labels, and a label tape suitable for the label sticking apparatus.

Another object of the present invention is to provide a label sticking apparatus which can stick circular bar code labels on spool flanges of photographic film cassettes at a high accuracy and a high speed, and a label tape of the circular bar code labels suitable for use in the label sticking apparatus.

SUMMARY OF THE INVENTION

To achieve the above objects, the present invention provides a suction drum having at least three holding-sticking units movably mounted therein and arranged at constant intervals in a circumferential direction of the suction drum, a drive mechanism for intermittently rotating the suction drum by a constant amount corresponding to said constant interval of said holding-sticking units such that said holding-sticking units are cyclically fed to and stopped at three or more stations disposed around the suction drum, a label feeding device for feeding a label toward the holding-sticking unit stopping at the first station, a label positioning device for positioning the label on the holding-sticking unit, and a pad pushing device for pushing the holding-sticking unit outward the suction drum to stick the label onto a work-piece. The label positioning device is disposed in association with the second station following the first station. The pad pushing device is disposed in association with the third station following the second station. Accordingly, these devices may be activated in parallel with each other.

In this way, different operational steps are performed concurrently at the different stations of the holding-sticking units provided around the suction drum. Accordingly, it is unnecessary to provide standby times between the operational steps, so that label sticking can be performed at a high speed. Furthermore, since the position of the label is corrected by the label positioning device before the sticking, the labels are precisely stuck on the work-pieces. Moreover, since the label positioning device is activated while the suction drum stops rotating, the accuracy of positioning is improved.

According to a preferred embodiment of the invention, a positioning device for positioning circular or ring-shaped label with an arc cut-out comprises a centering pin adapted to be inserted in the center hole of each label and a pair of angular position correction pins. The angular position correction pins are insertable in the arc cut-out and movable along a circumferential direction of the label in opposition to each other. For correcting the angular position of the label, the pins are apart from each other to push opposite margins of the arc cut-out.

The angular position correction is performed after the completion of the centering while the centering pin is inserted in the center hole. Therefore, the center of the label would not be deviated during the angular position correction. Furthermore, because the open angle between the angular position correction pin is appropriately selectable, it is possible to correct angular position of the circular label whatever angle the arc cut-out has. By adjusting the amount of insertion of the centering pin having a conical tip, or by interchanging the centering pin with another centering pin having a different diameter, it is possible to perform centering of the circular label whatever diameter the center hole has.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein.

DETAILED DESCRIPTION OF THE PREFERRED EMBODIMENT

Figure 1:
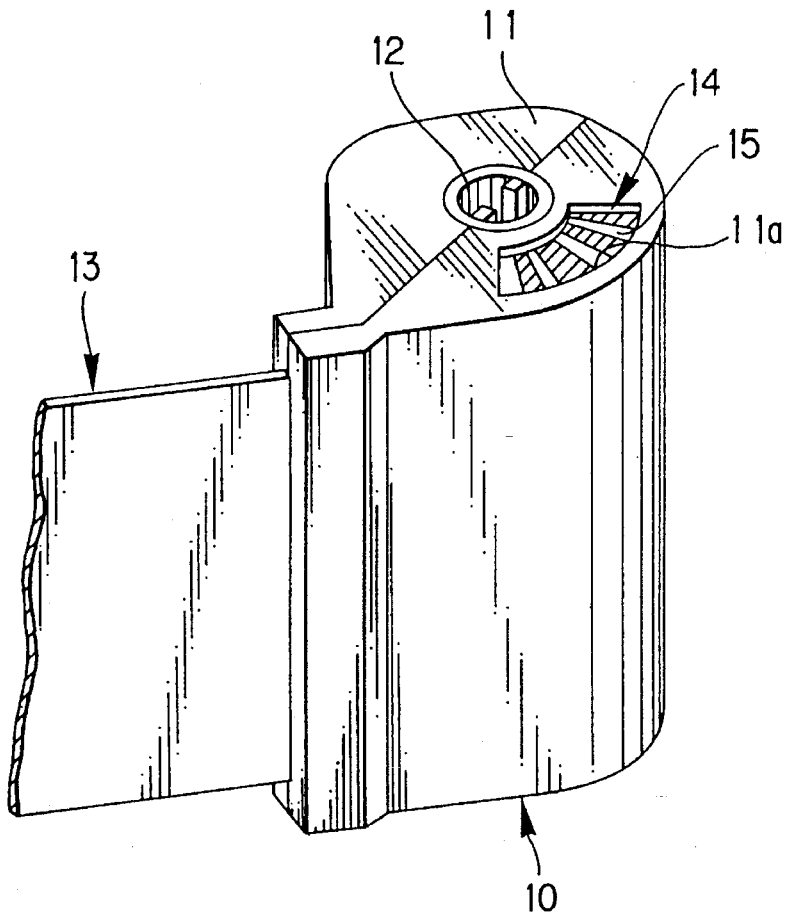
FIG. 1 is a perspective view of a photographic film cassette having a bar code disc attached to a cassette spool.

Referring to FIG. 1, a photographic film cassette 10 has a plastic cassette shell 11, a rotatable spool 12 and a photographic film 13 coiled around the spool 12 in the cassette shell 11. The spool 12 has a plastic core **12*a* and a pair of plastic flanges 12*b* fitted on the ends of the core 12*a* (see FIG. 4). One of the flanges 12*b* is used as a bar code disc by attaching a label 14 having bar codes 15 onto the outer surface thereof. The flange 12*b* with the bar code label 14 is partly exposed through a window 11*a* of the cassette shell 11 so as to permit reading the bar codes 15. The bar codes 15** are, for example, DX codes representing various information such as the sensitivity, the number of available frames, and so forth.

Figure 2:
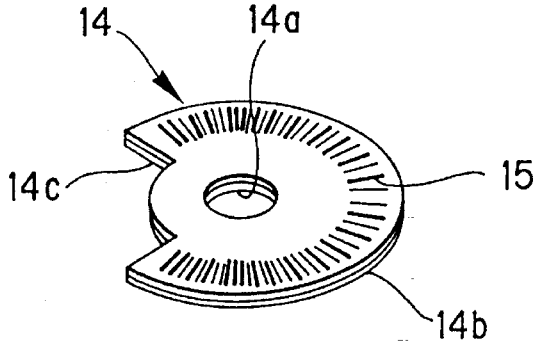
FIG. 2 is a perspective view of an example of the bar code disc.

As shown in FIG. 2, the bar code label 14 has a center hole **14*a* through which the bar code label 14 is fitted on one end of the spool core 12*a*. The center hole 14*a* is utilized for centering the bar code label 14 with respect to the spool core 12*a* when sticking the bar code label 14 on the flange 12*b*. The bar codes 15 are formed on the outer surface of the label 14. The opposite surface of the bar code label 14 is provided with an adhesive layer 14*b*. The bar code label 14 has a semicircular cut-out or arc recess 14*c*** in a peripheral range thereof which defines a black quiet zone.

Figure 3:
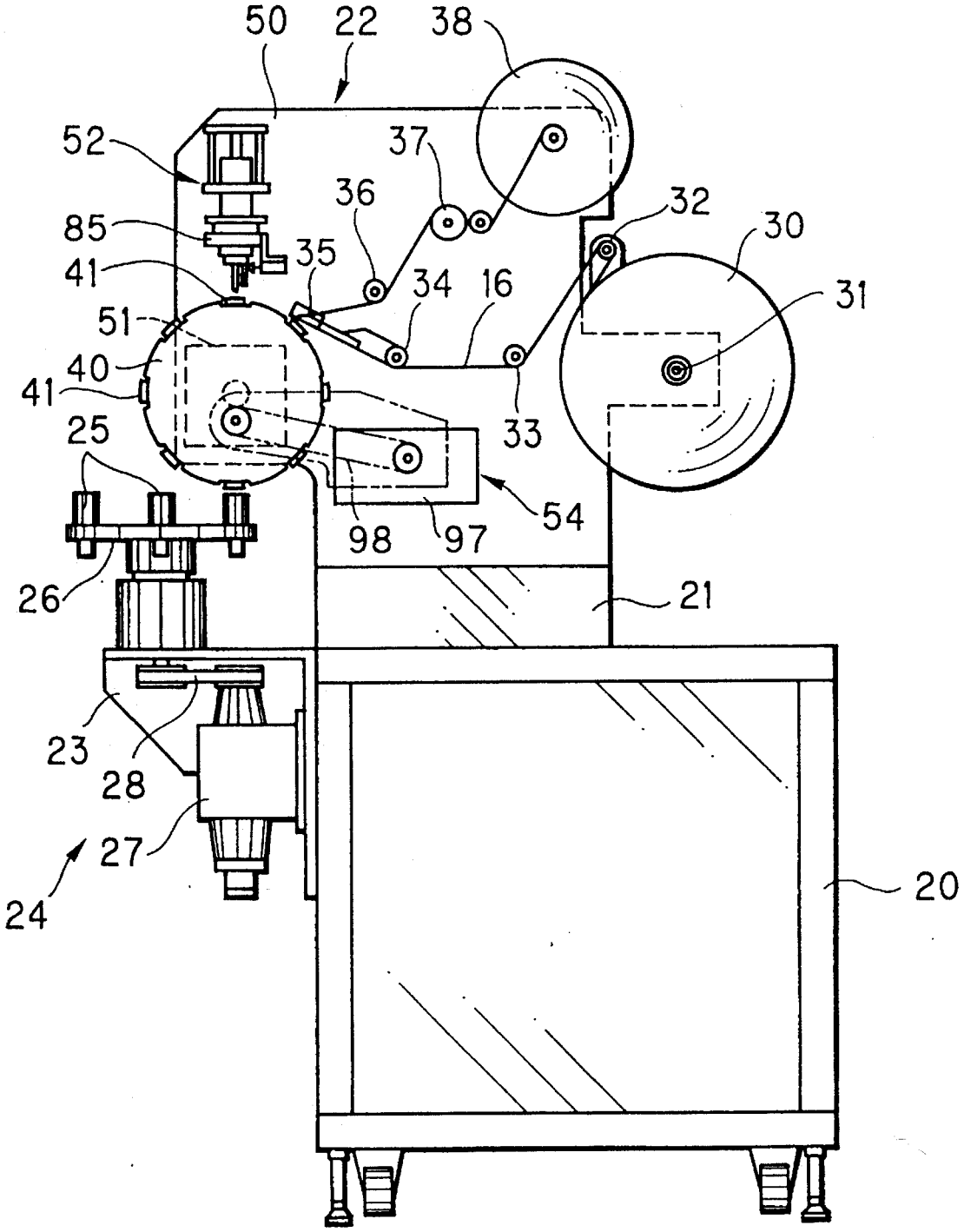
FIG. 3 is a side elevational view of a label sticking apparatus according to a preferred embodiment of the invention.
Figure 4:
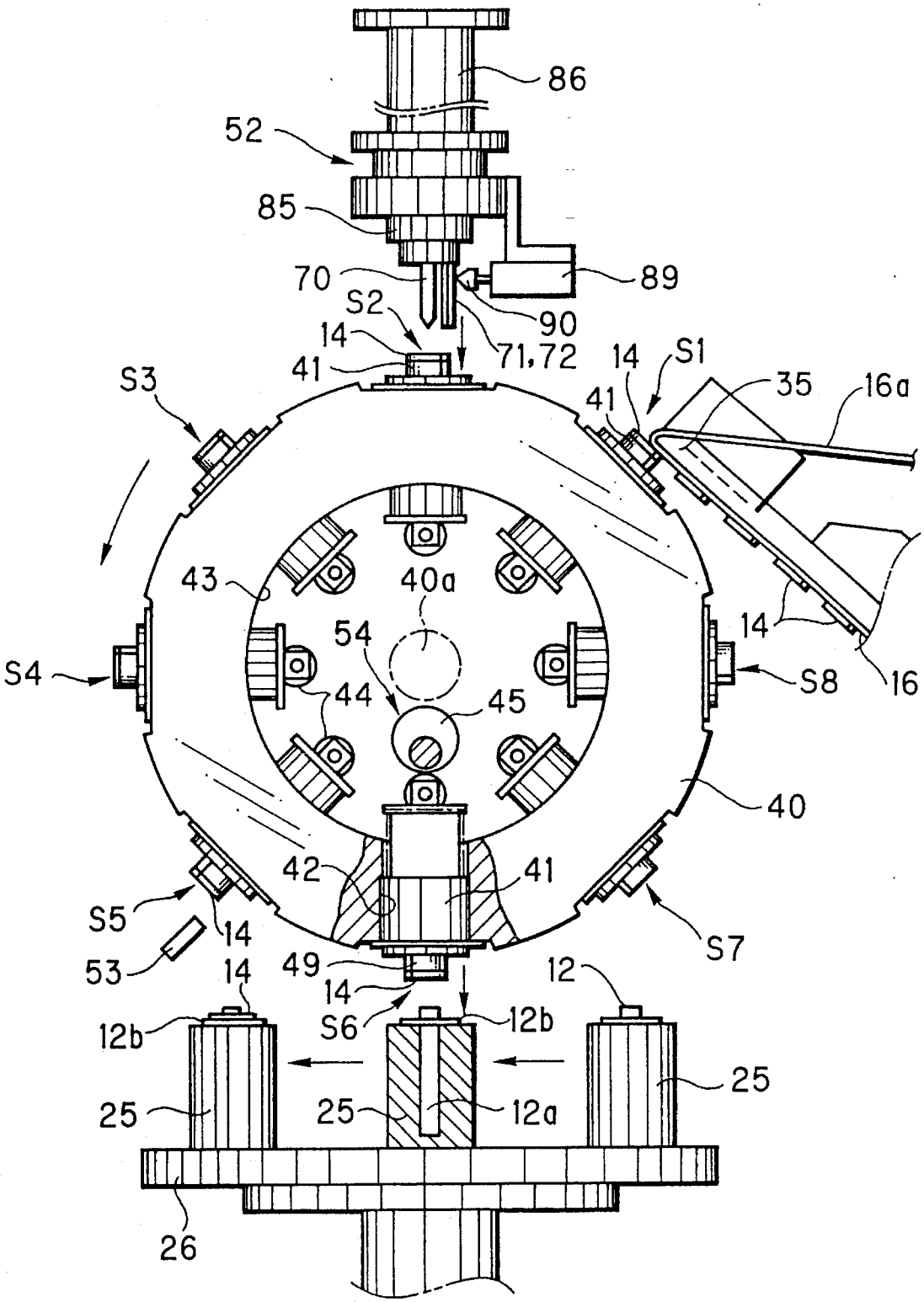
FIG. 4 is a front view, partly in section, illustrating essential parts of the label sticking apparatus shown in FIG. 3.

FIGS. 3 and 4 show a label sticking apparatus for sticking circular labels such as the bar code label 14, on circular work-pieces such as the flanges **12*b* of the spools 12. A sticking apparatus main body 22 is mounted on a base frame 20 through a position adjusting table 21, and a work-piece feeding device 24 is mounted on the base frame 20 through a bracket 23. The position adjusting table 21 has a bed for X-direction movement and a bed for Y-direction movement so as to be movable relative to the base frame 20** in X-Y directions for fine-adjustment of label sticking position, although the beds are not shown for clarity.

The work-piece feeding device 24 is constituted of a turn table 26 with a plurality of, e.g., four work-piece holders 25 for holding the spools 12. The turn table 26 is driven by a motor 27 through a timing belt 28 to rotate intermittently by an amount corresponding to the spacing between the work-piece holders 25. A not-shown spool supply device is provided at a first stop position of the work-piece holder 25, and the label 14 is stuck by the sticking apparatus main body 22 onto the spool 12 at a second stop position of the work-piece holder 25. A not-shown spool discharge device is provided at a third stop position of the work-piece holder 25. The number of the work-piece holders 25 in the turn table 26 may be other than four, but not less than three. Providing a lot of stop positions and work-piece holders makes it possible to increase the speed of operation and, if necessary, to perform other manufacturing processes such as assembly of the spool in other stop positions than the first to third stop positions.

Figure 5:
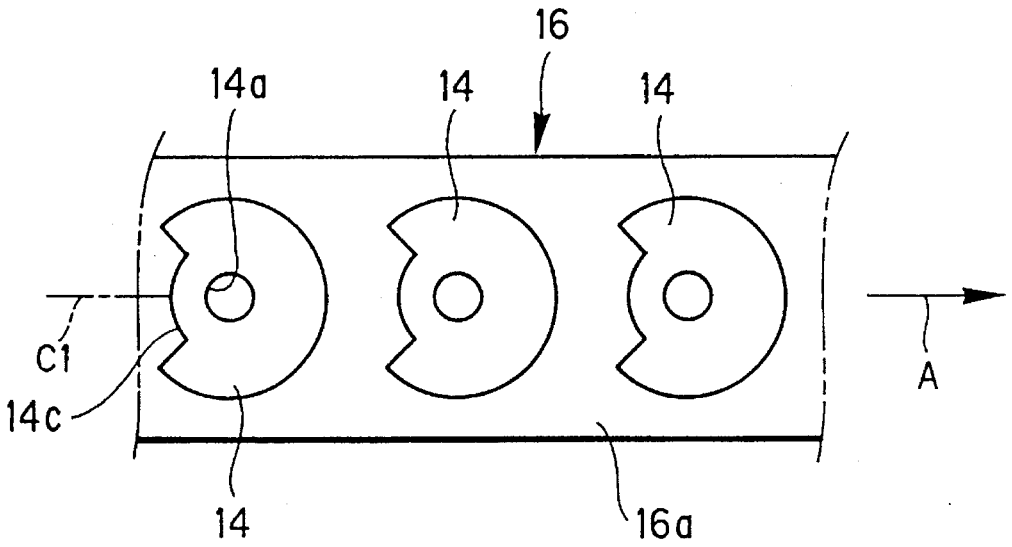
FIG. 5 is a fragmentary view of an example of label sheet for use in the label sticking apparatus shown in FIG. 3.

As shown in FIG. 5, the label tape 16 is constituted of a base tape **16*a* made of a releasing paper and the labels 14** removably attached on the releasing paper 16*a*. The labels 14 are aligned at regular intervals in the feeding direction A of the label tape 16 in the label sticking apparatus, and are orientated such that the cut-out 14*c* of each label 14 is disposed rearward in the feeding direction A.

Figure 6:
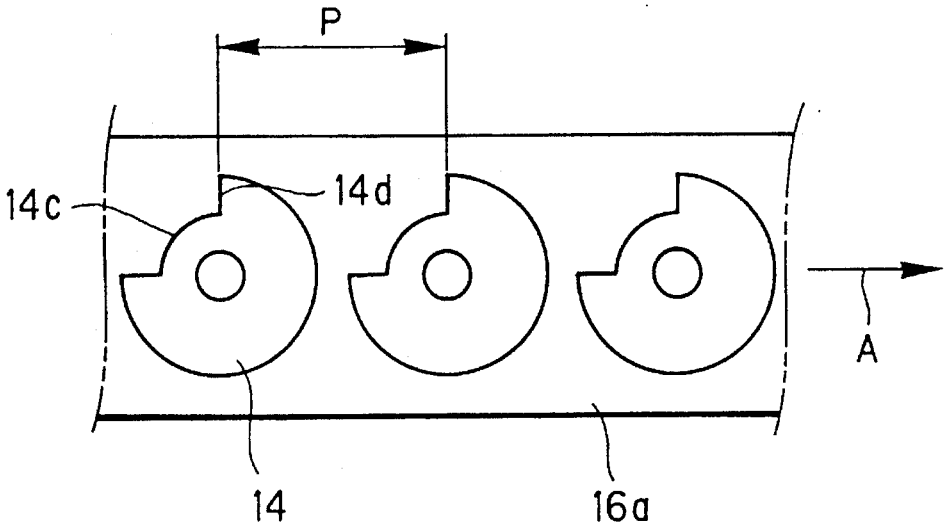
FIG. 6 is a fragmentary view of another example of label tape.

According to the embodiment shown in FIG. 5, a center line C1 of the cut-out 14*c* in the circumferential direction of the label 14 is aligned in the feeding direction A. However, it is possible to align one edge 14*d* of the cut-out 14*c* in a direction orthogonal to the feeding direction A, as is shown in FIG.6. Because the interval P between the labels 14 can be determined by detecting the edges 14*d*, this embodiment facilitates measuring the interval P between the labels 12 and thus improves the accuracy of measurement.

The label tape 16 is wound on a supply reel 30 which is mounted on a reel shaft 31. The label tape 16 withdrawn from the supply reel 30 is fed to a peeling edge 35 having an acute angle through guide rollers 33 and 34, while its tension is controlled by a dancer roller 32. The label tape 16 is bent at the acute angle by turning around the peeling edge 35, so that the label 14 on the bent portion of the label tape 16 is peeled from the base tape 16*a*. The base tape 16*a* is thereafter wound up on a take-up reel 38 through a guide roller 36 and a pair of feed rollers 37. The feed rollers 37 are controlled to feed the label tape 16 intermittently by an amount corresponding to the interval between the labels 14 along the label tape 16, so that the labels 14 may be seriatim peeled from the base tape 16*a* at the peeling edge 35 in synchronism with the interval of intermittent rotation of a suction drum 40 having a plurality of, e.g. eight, holding-sticking units 41. The label 14 peeled off the base tape 16*a* is adsorbed onto one of the holding-sticking units 41 which stops at a first station S1 of the suction drum 40, the station disposed in proximity to the peeling edge 35, as shown in detail in FIG.4.

The suction drum 40 has eight unit mounting holes 42 which are formed radially at regular spacings around the periphery of the drum 40, and the holding-sticking units 41 are mounted in the unit mounting holes 42. A round cavity 43 is formed in a center area of the suction drum 40, and an end of each holding-sticking unit 41 where a cam roller 44 is disposed is projected into the round cavity 43. Also an eccentric cam 45 is disposed in the round cavity 43. The cam 45 is adapted to contact the cam roller 44 of one of the holding-sticking units 41, and push the holding-sticking unit 41 radially outward through the cam roller 44, as described in detail below.

As indicated by dashed line in FIG. 3, a drive mechanism 51 for rotating the suction drum 40 is disposed inside a housing 50. The drive mechanism 51 drives the suction drum 40 to intermittently rotate about a horizontal shaft 40*a* by an angle of 45° in each interval so as to stop the holding-sticking units 41 at respective stations S1 to S8 of the sticking apparatus main body 22 which are disposed around the suction drum 40 at regular intervals corresponding to the eight unit mounting holes 42.

The label 14, which has been peeled from the base tape 16*a* at the peeling edge 35, is adsorbed onto the holding-sticking unit 41 at the first station S1, and is moved along with the holding-sticking unit 41 to the second station S2. In the second station S2, a label positioning device 52 disposed above the holding-sticking unit 41 performs centering and angular position correction of the label 14. The third, fourth, seventh and eighth stations S3, S4, S7 and S8 are spare stations. At the fifth station S5, a label sensor 53 or a pressure sensor determines if the label 14 is held by the holding-sticking unit 41 after the positioning. At the sixth station S6, a pushing device 54 pushes the suction arm 49 downward by means of the eccentric cam 45, so as to stick the label 14 onto the flange 12*b* of the spool 12 held in the work-piece holder 25 being on stand-by below the holding-sticking unit 41.

Figure 7:
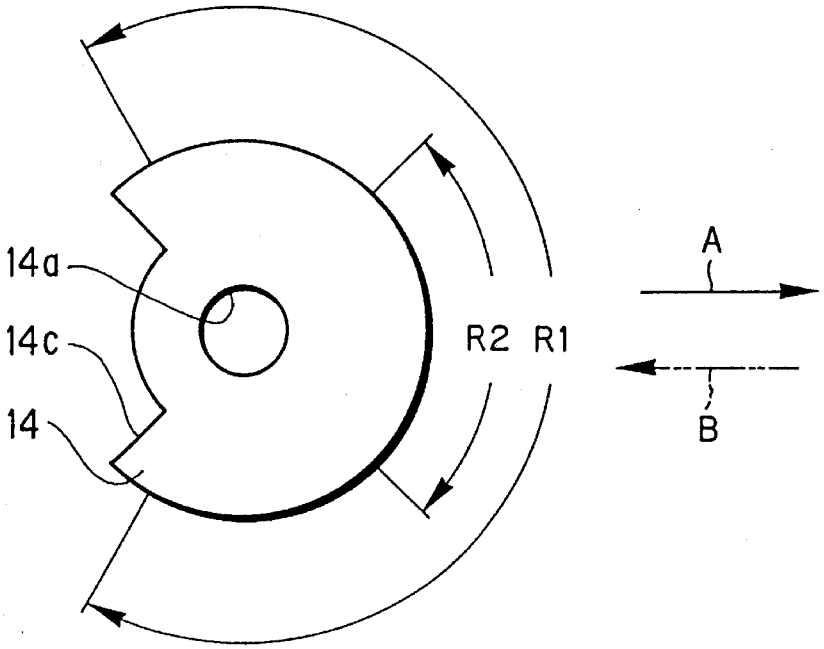
FIG. 7 is a view for explaining the orientation of the label on the label tape.

The orientation of the labels 14 on the base tape 16a with respect to the feeding direction A is not to be limited to the embodiments shown in FIGS. 5 and 6, but preferable peeling operation may be achieved by positioning an angular range R1 of each label 14, that is, the range R1 which excludes the range around the cut-out 14*c* forward in the feeding direction A, as shown in FIG. 7. Optimum peeling operation would be achieved by positioning an angular range R2 of each label 14, which is opposite to the cut-out 14*c* with respect to the center of the label 14, forward in the feeding direction A. In FIG. 7, an arrow B indicates the peeling direction of the label 14.

On the contrary, if the range around the cut-out 14*c* where to be positioned forward in the feeding direction A of the label tape 16, peeling of the label would tend to be troubled because at least two points of the label 14 should be peeled off at the starts of peeling, and that, the corners of the label 14 at the edges of the cut-out 14*c* may often cut into the base tape 16*a* when the labels 14 are blanked. Therefore, the label 14 would not be smoothly peeled off from these corners.

Figure 8:
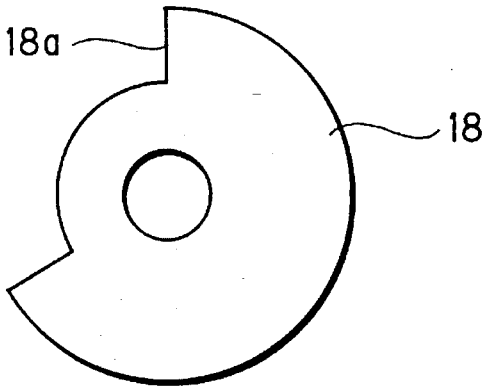
FIG. 8 is a schematic view of another example of the label.

It is to be noted that the open angle of the cut-out 14*c* is changeable depending on the angular range for recording the bar codes 14*a* thereon. As shown for example in FIG. 8, a label 18 may have an arc cut-out 18*a* whose open angle larger than that of the label 14 shown in FIG. 7. However, it is desirable to make the open angle of a cut-out of a bar code label less than 180° so that the corners of the label may not be positioned forward in the feeding direction.

Figure 9:
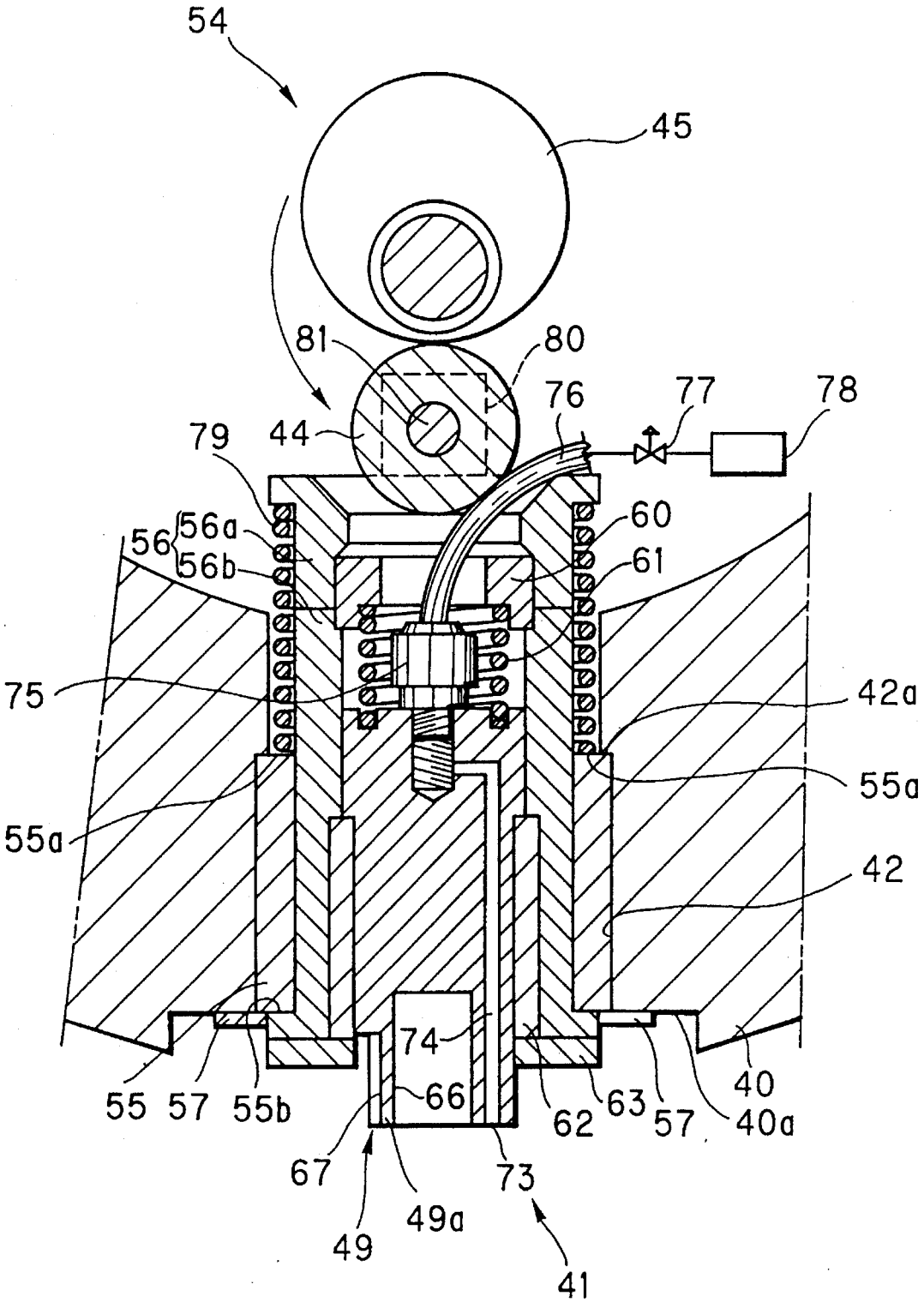
FIG. 9 is a sectional view illustrating essential parts of a holding-sticking unit of the label sticking apparatus shown in FIG. 3.

FIG. 9 shows the holding-sticking unit 41 stopping at the sixth station S6 under the eccentric cam 45. The holding-sticking unit 41 is constituted of a cylindrical suction arm 49, and outer and inner barrels 55 and 56 for holding the suction arm 49 to be axially movable therein and movable relative to the suction drum 40. The holding-sticking unit 41 is fitted in the unit mounting hole 42 of the suction drum 40 from outside. The unit mounting hole 42 has a stepped portion 42*a* formed around a middle portion thereof, and an end 55*a* of the outer barrel 55 which is disposed inside the suction drum 40 contacts against the stepped portion 42*a*. The opposite or distal end 55*b* of the outer barrel 55 is fixed by a retaining ring 57 which is fitted on the inner barrel 56, after the holding-sticking unit 41 is fitted in the unit mounting hole 42 and is secured to a recessed surface 40a formed on the periphery of the suction drum 40 surrounding the unit mounting hole 42 perpendicularly to the axial direction of the unit mounting hole 42.

The inner barrel 56 is separated into two parts 56*a* and 56*b* in the axial direction thereof which are joined together through screws or the like coaxially with each other. This construction facilitates assembling of the holding-sticking unit 41. The inner barrel 56 holds a spring confining ring 60, the suction arm 49 and a coiled spring 61 therein. These elements 60, 61 and 49 are prevented from dropping out of the inner barrel 56 through a confining sleeve 62 and a retaining ring 63.

The coiled spring 61 is sandwiched between the spring confining ring 60 and the suction arm 49, and is appropriately compressed so as to urge the suction arm 49 radially outward of the suction drum 40 and to permit the suction arm 49 to be depressed into the inner barrel 56 after the suction arm 49 is brought into contact with the flange 12*b* of the spool 12 held in the work-piece holder 25 in the sixth station S6, and when the inner barrel 56 is further moved downward by the action of the eccentric cam 45, as will be described in detail below. By virtue of the resiliency of the coiled spring 61, the suction arm 49 is tightly pressed against the flange 12*b* while the suction arm 49 is thus depressed into the inner barrel 56. Therefore, the label 14 held on a distal end 49*a* of the suction arm 49 is securely stuck onto the flange 12*b*.

Figure 10:
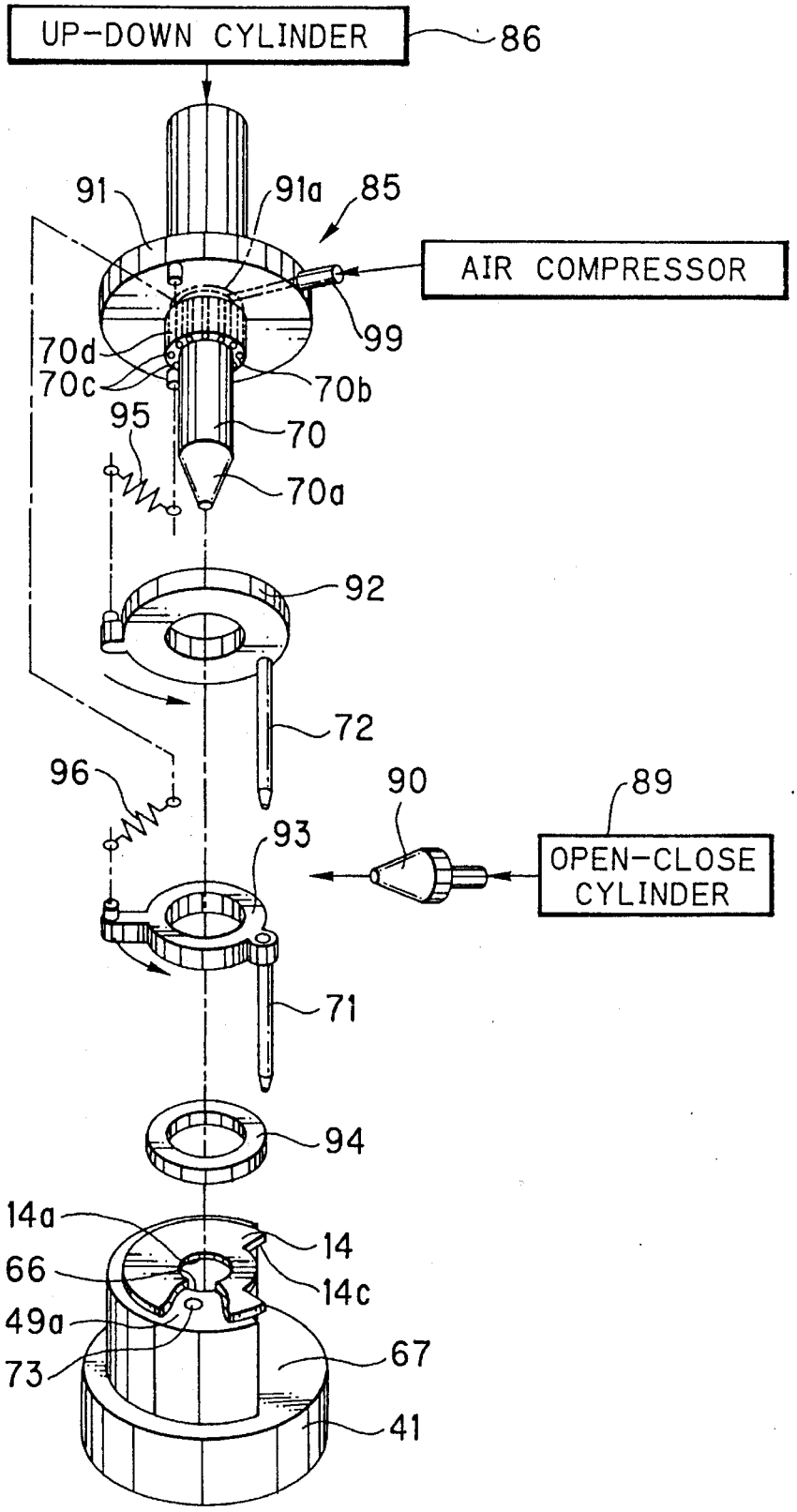
FIG. 10 is an exploded perspective view of a positioning head of the label sticking apparatus shown in FIG. 3.

The suction arm 49 is made of metal, preferably stainless steel, and has a coaxial guide hole 66 in the distal end 49*a* and a cut-out 67 in a part of the rim of the distal end 49*a*. The guide hole 66 receives a centering pin 70 (see FIGS. 4 and 10) for centering the label 14, and the cut-out 67 receives a pair of angular position correction pins 71 and 72 for correcting angular position of the label 14. The surface of the distal end 49*a* of the suction arm 49 is polished to be smooth by buffing. As shown in FIG.10, a plurality of suction nozzles 73 are also formed through the distal end 49*a*, which are connected to a suction tube 76 through respective air passageways 74 and a joint 75 whose external thread is connected to an internal thread of the suction arm 49. The suction tube 76 is connected to a vacuum tank 78 through an electromagnetic valve 77, so that the vacuum adsorption of the label 14 may be adjusted and terminated under the control of the electromagnetic valve 77.

A coiled spring 79 is mounted between the outer barrel 55 and the inner barrel 56 to urge the inner barrel 56 radially inward of the suction drum 40. The cam roll 44 is mounted to the inner end of the inner barrel 56 through a bracket 80 and a mounting shaft 81. The cam roll 44 is brought into contact with the eccentric cam 45 of the pushing device 54.

As shown in FIGS. 4 and 9, the label positioning device 52 is constituted of a positioning head 85, an up-down cylinder 86 for moving the positioning head 85 up and down, and an open-close cylinder 89 for opening and closing the angular position correction pins 71 and 72 of the positioning head 85. The up-down cylinder 86 and the open-close cylinder 89 are constructed by air cylinders which are driven by the power of compressed air supplied thereto. The open-close cylinder 89 is coupled to a correction pin actuating head 90 at a distal end of a rod of the cylinder 89. The correction pin actuating head 90 has a conical distal end which is inserted between the angular position correction pins 71 and 72 to separate the pins 71 and 72 from each other.

The positioning head 85 is constructed by a head main body 91, and a pair of positioning rings 92 and 93. The centering pin 70 is provided on the head main body 91 in the form of a stepped shaft made of Teflon. The distal end 70*a* of the centering pin 70 is shaped conical, and the conical end 70*a* is inserted in the center hole 14*a* of the label 14 held on the distal end 49*a* of the holding-sticking unit 41 stopping at the second station S2, thereby centering the label 14. A lot of air jet nozzles 70*c* are formed around the shoulder 70*b* of the stepped shaft 70. The air jet nozzles 70*c* are connected to a compressed air supply tube 99 through an air passageway 91*a* formed through the head main body 91. The compressed air supply tube 99 starts supplying compressed air immediately before the positioning head 85 starts removing upward from the holding-sticking unit 41 after the completion of positioning of the label 14. The supply of the compressed air is interrupted when the positioning head 85 reaches its topmost position. In this way, the air jet nozzles 70*c* eject air jet when the centering pin 70 is removed from the center hole 14*a* of the label 14, so that the label 14 may not be lifted together with the centering pin 70, which could otherwise happen due to the adhesive layer 14*b* of the label 14.

The positioning rings 92 and 93 are rotatably mounted on a base portion 70*d* of the stepped shaft or centering pin 70, and are retained by a retaining ring 94 so as not to drop off the base portion 70*d*. The retaining ring 94 itself is secured to the head main body 91 by screws. The angular position correction pins 71 and 72 are made of stainless steel, and are secured to the positioning rings 92 and 93, respectively. The positioning rings 92 and 93 are urged by coiled springs 95 and 96 to rotate in opposite directions so as to close the position correction pins 71 and 72 to each other. As a result, the angular position correction pins 71 and 72 are usually set close to each other with such a slight gap that permits insertion of the tip of the correction pin actuating head 90. The open-close cylinder 89 thrusts the correction pin actuating head 90 between the angular position correction pins 71 and 72 by a given amount after the up-down cylinder 86 pushes the positioning head 85 downward to insert the centering pin 70 into the centering pin 14*a* of the label 14. Then, the angular position correction pins 71 and 72 are separated from each other by an amount corresponding to the arc cut-out 14*c* of the label 14, so that the label 14 is rotated about the center hole 14*a* to correct the angular position thereof.

As shown in FIGS. 3 and 9, the pushing device 54 is constituted of the eccentric cam 45, a motor 97, and a timing belt 98 for transmitting the rotation of the motor 97 to the eccentric cam 45. While the eccentric cam 45 makes one rotation, the inner barrel 56 is pushed downward through the cam roll 44. Thereby, the suction arm 49 is moved downward to press the label 14 against the flange 12*b* of the spool 12, so that the label 14 is stuck on the flange 12*b* through the adhesive layer 14*b*.

Now, the operation of the above-described label sticking apparatus will be described. As shown in FIG.3, the label tape 16 wound on the supply reel 30 is set on the reel shaft 31, and a leader tape of the label tape 16 is guided through the transporting path constituted of the rollers 32, 33, 34, 36 and 37 and the peeling edge 35, so as to be secured to the take-up real 38. A not-shown label sensor detects the label 14 approaching the peeling edge 35 so as to stop the label tape 16 at a position where the label 14 is partly peeled from the base tape 16a because of the acute bending of the base tape 16*a* at the peeling edge 35. The partly peeled label 14 is held by the holding-sticking unit 41 which stops at the first station S1 of the suction drum 40. Thereafter, the suction drum 40 is rotated by one step to move the holding-sticking unit 41 holding the label 14 to the second station S2. Concurrently, the next holding-sticking unit 41 with no label 14 is positioned in the first station S1 for adsorptively receiving the next label 14 from the label tape 16.

At the second station S2, the positioning head 85 moves down to perform centering and angular position correction of the label 14. First, the centering pin 70 is inserted into the center hole 14*a* of the label 14 to center the label 14 on the holding-sticking unit 41. As shown in FIG.4, the label sensor 53 determines at the fifth station S5 if the label 14 is held by the holding-sticking unit 41, and outputs a label detection signal to a not-shown controller. After the suction drum 40 is rotated by one step following the label detection, the controller actuates the pushing device 54 depending on the label detection signal, to stick the label 14 onto the flange 12*b* of the spool 12 held in the work-piece holder 25. To move the holding-sticking unit 41 downward, the eccentric cam 45 rotates to push the inner barrel 56 downward through the cam roller 44. Further to the position where the suction arm 49 contacts against the flange **12*b* of the spool 12, the inner barrel 56 is still pushed downward by a small amount. As a result, the suction arm 49 tightly presses the label 14 onto the flange 12*b* under the resilient force of the coiled spring 61, so that the label 14 is unfailingly stuck on the flange 12*b*. At the end of one rotation of the eccentric cam 45, the inner barrel 56 is moved inward the suction drum 40 under the force of the coiled spring 79** to return to the initial position.

Experimental data of the performance of the label sticking apparatus of the present invention was obtained from the following examples which illustrate preferred operations within the scope of the present invention:

[LABEL STICKING APPARATUS]

A label sticking apparatus constructed as shown in FIG. 3 and having a height of 1600 mm, a width of 750 mm and a depth of 1100 mm was used. The holding-sticking unit was made of stainless steel of 47 mm thick.

[LABEL TAPE]

A label tape constructed as shown in FIG. 5 and having a width of 21 mm was used. The length of the label tape 10 initially wound on the supply reel was about 375 m, and the external diameter of the supply reel was about 300 mm.

The label having the shape as shown in FIG. 2 was dimensioned to have an external diameter of 17.5 mm. The angle of the arc cut-out was 126°, the diameter of the center hole was 8.6 mm. An acrylic adhesive agent was used for the adhesive layer. The interval P between the labels was 20.6 mm.

[WORK-PIECE]

The work-pieces to be labeled were each constituted of a cylindrical spool core having an internal diameter of 7 mm, an external diameter of 12 mm and a length of 38 mm, and a circular flange having an external diameter of 18.5 mm and a thickness of 0.9 mm. The work-pieces were successively supplied to the work-piece holder at intervals of 78 mm.

[OPERATIONAL CONDITIONS]

Vacuum pressure of the holding-sticking unit was 240 mmHg. Rotational speed of the motor for the turn table was 54.5 rpm. Rotational speed of the motor 54 for the pushing device was 198 rpm.

[RESULT OF PERFORMANCE]

Sticking speed was 84 pieces/min, and accuracy of sticking was ± 0 to 0.1 mm at a cycle of 0.7 sec.

[COMPARISON]

Figure 11:
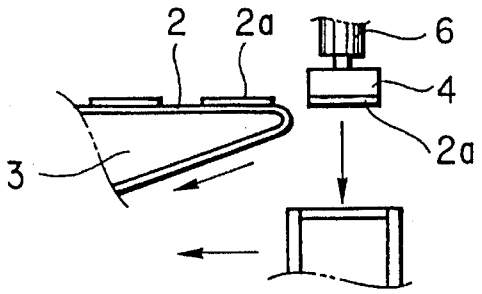
FIG. 11 (PRIOR ART)
FIG. 11 is a front view illustrating essential parts of a conventional label sticking apparatus.
Figure 12:
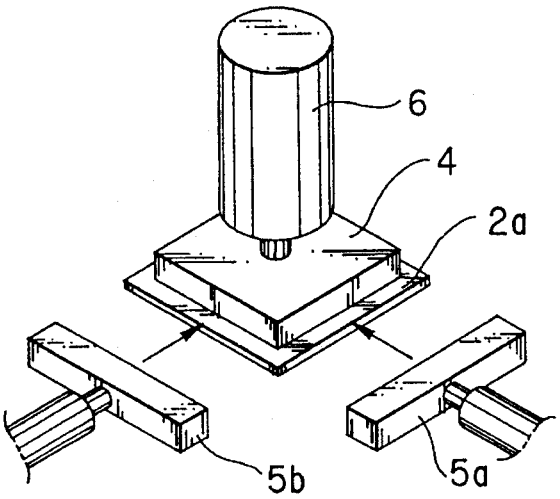
FIG. 12 (PRIOR ART)
FIG. 12 is a perspective view of a positioning device of the conventional label sticking apparatus.
Figure 13:
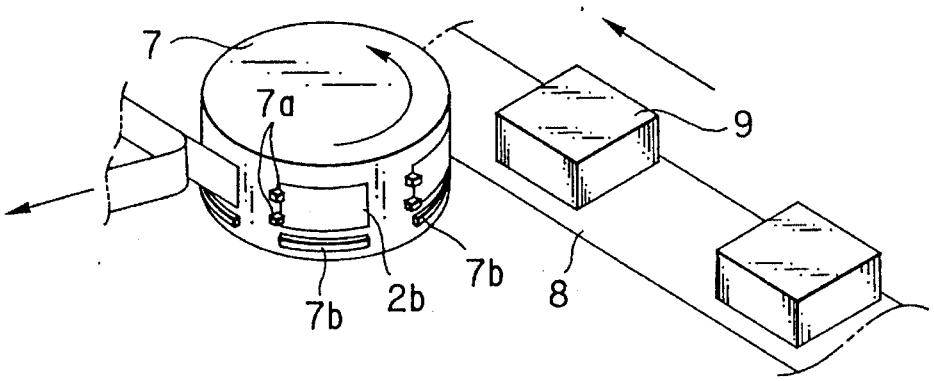
FIG. 13 (PRIOR ART)
FIG. 13 is a perspective view illustrating essential parts of another conventional label sticking apparatus.

Maximum performances of the conventional label sticking apparatuses as shown in FIGS. 11 to 13 were as follows: cycle time as 2 to 3 sec., sticking speed was 20 to 30 pieces/min, and accuracy of sticking was + 0 to 0.5 mm.

While the preferred embodiment of the present invention has been described with respect to a label sticking apparatus for sticking circular bar code labels on plastic flanges of spools, the present invention should not be limited to the preferred embodiment shown in the drawings. The present invention is applicable to sticking any kind of labels, e.g., thermosensitive labels having hot-melt adhesive layer or a rolled label which is to be coated with adhesive bond, besides tack labels having self-bonding adhesive layer.

The present invention is also applicable to sticking labels of any shape such as rectangular, polygonal, oval and so forth. Although bar codes 15 are previously printed on the label 14 in the above-described embodiment, it is possible to use white labels or labels made of thermosensitive recording paper, and record bar codes on those labels after they are stuck to an object.

Work pieces to be labeled may be made of any material besides plastics such as PE (polyethylene) or PS (polystyrene). For example, work-pieces to be labeled may be made of paper, aluminum, aluminized PE or PS.

Although the suction drum 40 is provided with eight holding-sticking units 41 in the above-described embodiment, the number of holding-sticking units may be other than eight, but not less than three. The larger number of holding-sticking units 41 makes the rotational amount for one interval of the intermittent rotation the smaller, so that the sticking speed can be made the higher. By increasing the number of stations in association with the increase of the number of the holding-sticking units 41, it becomes possible to gradually correct the label position through several stations, so that major correction and/or fine adjustment may be performed. Thereby, the accuracy of positioning is improved. One station may be utilized for heating the thermosensitive label, or for coating the rolled label with an adhesive bond. Although the label sensor 53 for checking the presence of the label on the holding-sticking unit is disposed at the fifth station S5, the label sensor 53 may be disposed between the stations if all the stations are utilized for other operational steps.

The rotary shaft of the suction drum may extend vertical instead of horizontal, so that the suction drum rotates in a horizontal plane. It may be possible to arrange the holding-sticking units parallel to the rotational axis of the suction drum around the suction drum. In that case, the label feeding device, the positioning device and the work-piece feeding device may be disposed on one side of the suction drum.

Positioning of the labels is carried out without changing vacuum pressure in the above-described embodiment. However, it is possible to lower the adsorbability of the holding-sticking unit 41 during the label positioning operation. It is also possible to perform centering and angular position correction of the labels individually at different stations, instead of performing these steps at the same station by the positioning head 85 in which the centering pin 70 and the angular position correction pins 71 and 72 are integrated therein.

Also, it will be apparent to one skilled in the art that various other modifications can be made to the disclosed embodiments without departing from the scope of the invention as defined by the appended claims.

What is claimed is:

1. A label sticking apparatus for sticking labels on work-pieces comprising:

a suction drum having at least three holding-sticking units mounted to be movable therein and arranged at constant intervals around said suction drum, each of said holding-sticking units being capable of holding one of said labels thereon by vacuum suction;

a drive mechanism for intermittently rotating said suction drum by a constant amount corresponding to said constant interval of said holding-sticking units such that said holding-sticking units are cyclically fed to and stopped at first, second and third stations disposed around said suction drum;

a label feeding device for successively feeding said labels toward one of said holding-sticking units which stops at the first station when the rotation of said suction drum stops;

a label positioning device for positioning one of said labels on said holding-sticking unit, said label positioning device being disposed in association with the second station following the first station in the rotating direction of said suction drum;

a suction unit comprising a metal suction arm, a barrel member for holding said suction arm, said suction arm being movable in a radial direction of said suction drum, and a biasing member for urging said suction arm to move toward a center of said suction drum, a distal end of said suction arm being even and smooth and having at least a suction nozzle; and a pushing device for pushing said holding-sticking unit toward one of said work-pieces to press and stick one of said labels onto said one of said work-pieces, said pushing device being disposed in association with the third station following the second station in the rotating direction of said suction drum.

2. A label sticking apparatus as claimed in claim 1, wherein there are provided more than three stations around said suction drum.

3. A label sticking apparatus as claimed in claim 1, further comprising a work-piece feeding device for feeding said work-piece toward said third station in synchronism with the intermittent rotation of said suction drum.

4. A label sticking apparatus as claimed in claim 3, wherein said work-piece feeding device is a turn table having at least three work-piece holders arranged at constant intervals in a circumferential direction of said turn table, said turn table being driven to rotate intermittently in synchronism with said suction drum.

5. A label sticking apparatus for sticking circular labels with a center hole on circular work-pieces coaxially with each other comprising:

a suction drum having at least three holding-sticking units mounted to be movable therein and arranged at constant intervals in a circumferential direction of said suction drum, each of said holding-sticking units being capable of holding one of said circular labels thereon by vacuum suction;

a drive mechanism for intermittently rotating said suction drum by a constant amount corresponding to said constant interval of said holding-sticking units such that said holding-sticking units are cyclically fed to and stop at three or more stations disposed around said suction drum;

a label feeding device for successively feeding said circular labels toward one of said holding-sticking units which stops at a first one of said stations when the rotation of said suction drum stops;

a label positioning device for positioning one of said circular labels on said holding-sticking unit, said label positioning device being disposed in association with a second one of said stations following said first station in the rotating direction of said suction drum and having a centering pin which is inserted into said center hole of one of said circular labels for a moment while said holding-sticking unit stops at said second station, said circular label further has an arc cut-out in its rim, and said label sticking apparatus further comprises a second positioning device for correcting angular position of said circular label, said second positioning device comprising a pair of correction pins insertable in said arc cut-out and movable in opposite direction with respect to each other along a circumferential direction of said circular label, and a pin actuating device for causing said correction pins to push opposite edges of said arc cut-out as said correction pins move apart from each other; and a pushing device for pushing said holding-sticking unit toward one of said work-pieces to stick said circular label onto said one of said work-pieces, said pushing device being disposed in association with a third one of said stations following said second station.

6. A label sticking apparatus as claimed in claim 5, wherein said centering pin has a conical tip.

7. A label sticking apparatus as claimed in claim 6, wherein said centering pin has a shoulder around a base portion thereof and a plurality of air jet nozzles formed through said shoulder for blowing said label off said centering pin when said centering pin is to be removed from said center hole of said label after centering.

8. A label sticking apparatus as claimed in claim 5, wherein said first and second positioning devices are integrated into one unit such that said centering pin and said correction pins are concurrently inserted in said center hole and said arc cut-out of said label, respectively.

9. A label sticking apparatus as claimed in claim 8, wherein said correction pins are projected in parallel to said centering pin from a pair of rings which are fitted on a base portion of said centering pin to be rotatable about said centering pin so as to permit opening and closing the spacing between said correction pins.

10. A label sticking apparatus as claimed in claim 9, wherein a hole for receiving said centering pin and a cutout for receiving said correction pins are formed in said distal end of said suction arm.

11. A label sticking apparatus as claimed in claim 5, further comprising a base tape made of releasing paper, and wherein said circular labels each have an arc cut-out and an adhesive layer formed on its back surface, said labels being removably stuck on said base tape through said adhesive layer and arranged at constant intervals along an advancing direction of said label tape such that said arc cut-outs are orientated rearward with respect to said advancing direction and a convex arcuate portion of said labels is forward in said advancing direction.

12. A label sticking apparatus for sticking labels on work-pieces comprising:

a suction drum having at least three holding-sticking units mounted to be movable therein and arranged at constant intervals around said suction drum, each of said holding-sticking units being capable of holding one of said labels thereon by vacuum suction;

a drive mechanism for intermittently rotating said suction drum by a constant amount corresponding to said constant interval of said holding-sticking units such that said holding-sticking units are cyclically fed to and stopped at first, second and third stations disposed around said suction drum;

a label feeding device for successively feeding said labels toward one of said holding-sticking units which stops at the first station when the rotation of said suction drum stops;

a label positioning device for positioning one of said labels on said holding-sticking unit, said label positioning device being disposed in association with the second station following the first station in the rotating direction of said suction drum; and a pushing device for pushing said holding-sticking unit toward one of said work-pieces to press and stick one of said labels onto said one of said work-pieces, said pushing device being disposed in association with the third station following the second station in the rotating direction of said suction drum;

wherein each of said holding-sticking units comprises a fixed barrel extending in a radial direction of said suction drum, a movable barrel mounted in said fixed barrel to be axially movable therein, and a metal suction arm mounted in said movable barrel to be axially movable therein, a first biasing member for urging said movable barrel to move to a center of said suction drum, and a second biasing member of urging said suction arm to move radially outward from said suction drum.

13. A label sticking apparatus as claimed in claim 12, wherein said metal suction arm has a distal end which is even and smooth and has at least a suction nozzle.

14. A label sticking apparatus as claimed in claim 13, wherein said pushing device comprises a cam member which is adapted to contact said movable barrel of said holding-sticking unit at said third station, and is driven to push said movable barrel radially outward from said suction drum so as to press said distal end of said suction arm onto said work-piece.

15. A label sticking apparatus as claimed in claim 14, wherein said distal end protrudes radially outward from said movable barrel and is retractable into said movable barrel against the force of said second biasing member when said distal end is pressed against said work-piece as said pushing device pushes said holding-sticking unit.

* * * * *